United States Patent [19]

Doi

[11] 4,287,519

[45] Sep. 1, 1981

[54] MULTI-MODE LUNEBERG LENS ANTENNA

[75] Inventor: Kazumasa Doi, Ventura, Calif.

[73] Assignee: The United States of America as represented by the Secretary of the Navy, Washington, D.C.

[21] Appl. No.: 137,177

[22] Filed: Apr. 4, 1980

[51] Int. Cl.[3] ..... H01Q 19/06

[52] U.S. Cl. ..... 343/725; 343/755; 343/911 L

[58] Field of Search ..... 343/725, 726, 729, 754, 343/755, 911 L

[56] References Cited

U.S. PATENT DOCUMENTS 3,787,856 1/1974 Pyrah ..... 343/911 L

*Primary Examiner*—Eli Lieberman

*Attorney, Agent, or Firm*—Richard S. Sciascia; Joseph M. St.Amand

[57] ABSTRACT

An antenna system having a multiple of antenna feeds to drive a microwave lens, composed primarily of a Luneberg lens and a metallic ground plane upon which are mounted three antenna feeds and a shorted stub (or four bent-stub coaxial feeds). The antenna system uses a common aperture to provide antenna performance for the three separate feeds, conserving space that would normally be required for three separate high gain antennas.

15 Claims, 16 Drawing Figures

MULTI-MODE LUNEBERG LENS ANTENNA

BACKGROUND OF THE INVENTION

This invention is related to antennas and particularly to an antenna system using three or more feeds to drive a microwave lens and using a common antennas aperture.

The use of prior art antenna systems have been found to be unsatisfactory for the specific systems requirements of an antenna to be used with two or more auxiliary systems where space and design configuration are limited. This has been particularly true where the antenna is used to transmit performance for a plurality of systems especially where one system requires high power, horizontally polarized radiation at a specified (X-band) microwave frequency, and another system requires horizontally polarized radiation over a different (e.g., C-band) microwave frequency and vertically polarized microwave radiation over an octave frequency bandwidth (X-band through C-band). The present invention overcomes many of the shortcomings of the prior art systems to provide mufliple antenna radiation beams in the same direction using a Luneberg lens in combination with bent-stub coaxial feeds, or a combination of bent-stub coaxial feeds, a waveguide feed and a shorted stub coupled to a metallic ground plane.

SUMMARY OF THE INVENTION

A microwave antenna system that uses multiple antenna feeds to drive a microwave lens is primarily composed of a Luneberg lens and a metallic ground plane upon which are mounted three antenna feeds and a shorted stub. The Luneberg lens is used to focus microwave transmission to or from the various antenna feeds; the focusing effect results in high gain and narrow beam-width. A common antenna aperture provides antenna performance for three separate antenna feeds, and conserves space that would normally be required for three high gain antennas.

DESCRIPTION OF THE PREFERRED EMBODIMENT

Figure 1:
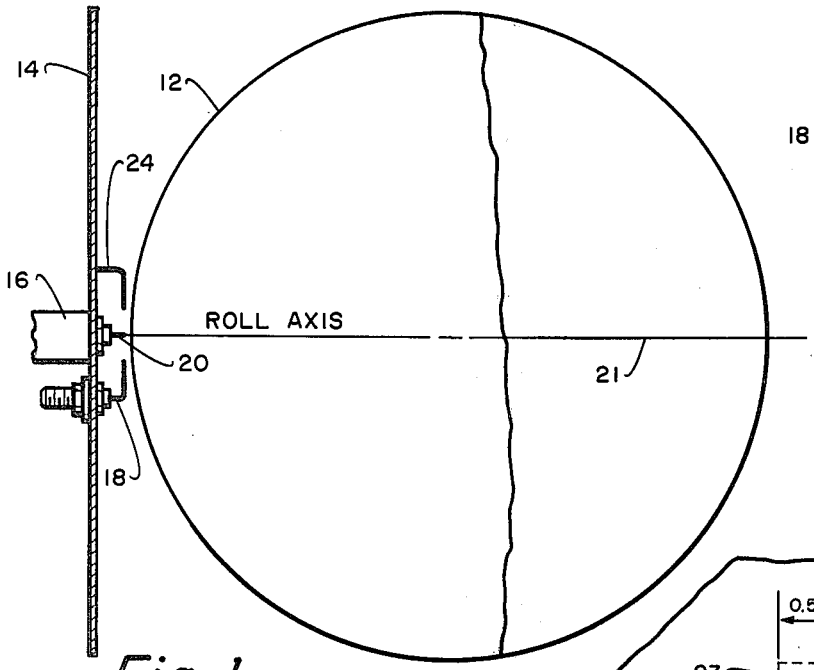
FIG. 1 is a top plan view of the multi-mode microwave lens antenna of this invention.

The multi-mode microwave lens antenna of this invention uses multiple antenna feeds (ports) to drive a microwave lens (Luneberg lens). The embodiment of antenna system shown in FIGS. 1–4 is principally comprised of a Luneberg lens 12 (e.g., 7-inch diameter spherical lens), and a metallic ground plane 14 upon which are mounted a waveguide feed 16, a horizontally-polarized coaxial feed 18, and a vertically-polarized coaxial feed 20. The ground plane is mounted such that its center is as close to the focal point of the Luneberg lens as possible. Typical dimensions are shown in FIGS. 4*a, b* and *c*. The roll axis 21 of the antenna is normal to the ground plane 14 and passes through the center of the ground plane. The purpose of the Luneberg lens 12 is to focus the microwave transmissions to and from the various antenna feeds 16, 18 and 20. The focusing effect results in antenna performance with high gain and narrow bandwidth. The dimensions and frequencies used herein are merely given by way of example for discussing a typical antenna.

The ground plane should be approximately 2 $\lambda$ in diameter or larger; however, it is structurally more convenient for the ground plane to be the same diameter as the microwave lens as shown in the drawings. The lens size is usually determined by the desired direction of the radiation pattern together with the positions of the antenna feeds.

Figure 3A:
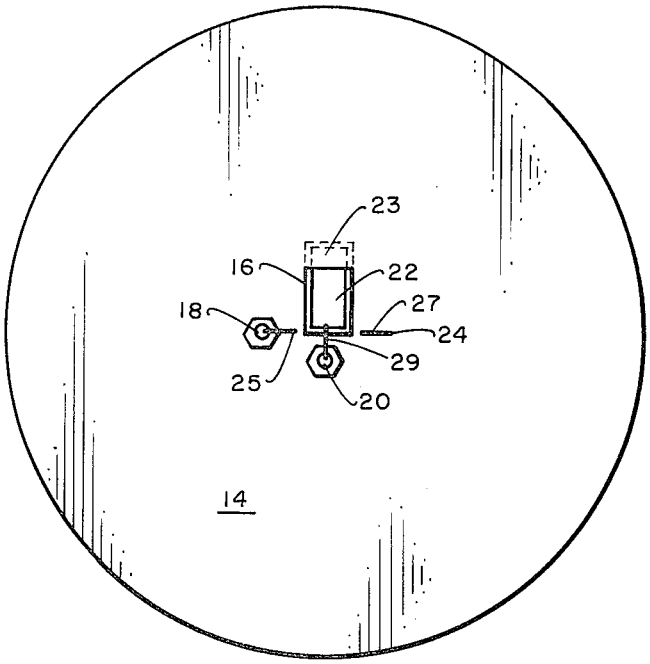
FIG. 3*a* is planar view of the ground plane with antenna feeds, taken along line 3*a*—3*a* of FIG. 2.
Figure 5:
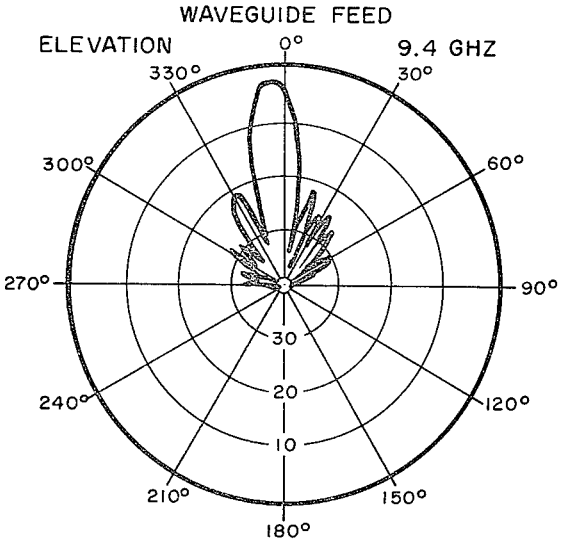
FIG. 5 is a typical elevation radiation pattern for the antenna waveguide feed shown in FIGS. 1–4.
Figure 6:
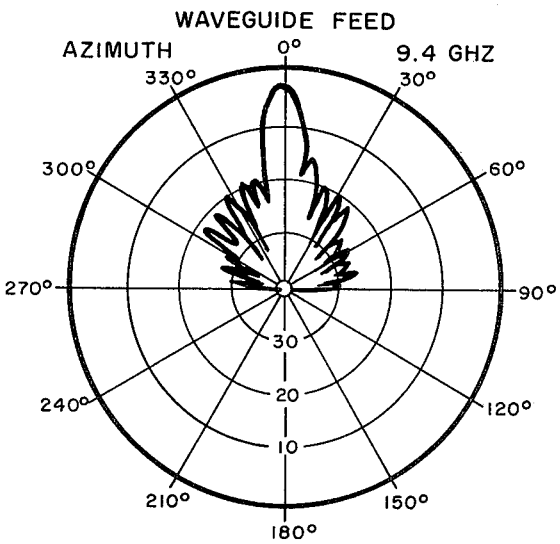
FIG. 6 is a typical azimuth radiation pattern for the antenna waveguide feed shown in FIGS. 1–4.

Waveguide feed 16 is oriented such that its radiation is horizontally-polarized. This feed is an open-ended waveguide which is mounted normal to ground plane 14. The lower edge 17 of waveguide feed 16 is located adjacent to the center of the ground plane as shown in FIGS. 3*a* and 4*a*. The waveguide feeds microwave energy through a rectangular orifice 22 in the ground plane. The width (horizontal dimension) of orifice 22 is equal to the width of waveguide feed 16. By design, the height (vertical dimension) of orifice 22 is less than the height of the open-ended waveguide feed 16. Hence, the ground plane forms an iris 23 on the upper portion of the open-ended waveguide feed as shown. This iris 23 electrically matches the feed impedance for a given microwave frequency, thereby, reducing the standing wave ratio at that frequency. The radiation patterns for this waveguide feed are shown in FIGS. 5 and 6. The antenna gain is approximately 23 decibels with respect to isotropic radiation (dBi), and the radiation is directed approximately 5 degrees below the roll axis of the antenna. The antenna beamwidth is approximately 11 degrees in elevation (FIG. 5) and approximately 9 degrees in azimuth (FIG. 6).

Figure 4B:
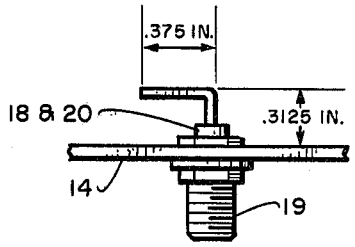
FIG. 4*b* is an enlarged side view of a bent-stub coaxial feed, showing typical dimensions.
Figure 4A:
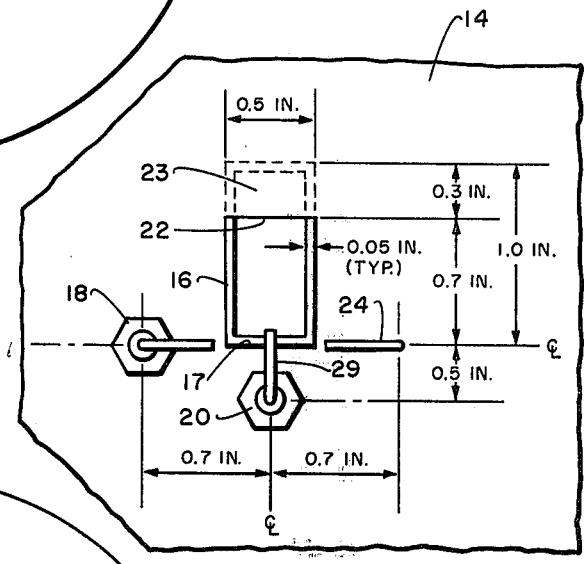
FIG. 4*a* is an enlarged detail view of the central portion of the ground plane with antenna feeds, giving typical dimensions.
Figure 4C:
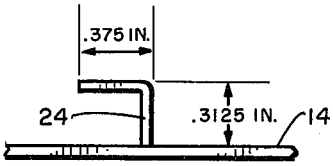
FIG. 4*c* is an enlarged side view of a bent shorted stub, showing typical dimensions.
Figure 3B:
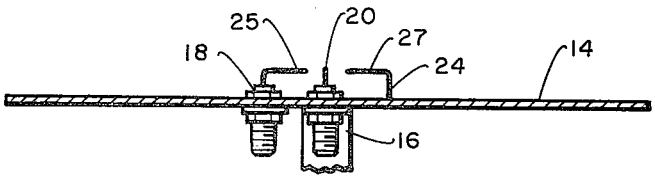
FIG. 3*b* is an edge view of the ground plane with antenna feeds, taken along line 3*b*—3*b* of FIG. 2.
Figure 7:
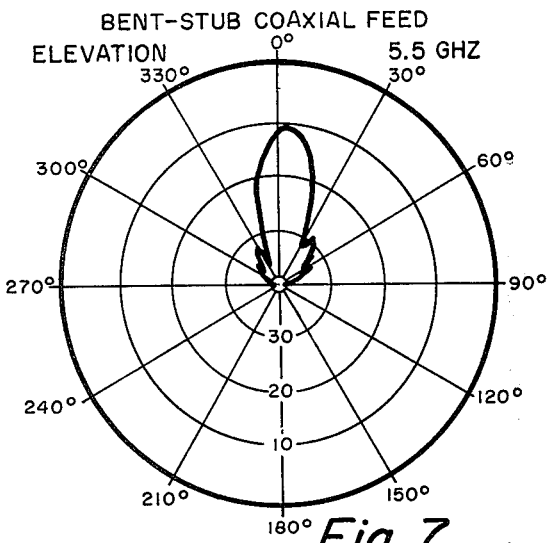
FIG. 7 shows a typical elevation radiation pattern for the antenna horizontally-polarized coaxial feed in conjunction with a grounded bent-stub.
Figure 8:
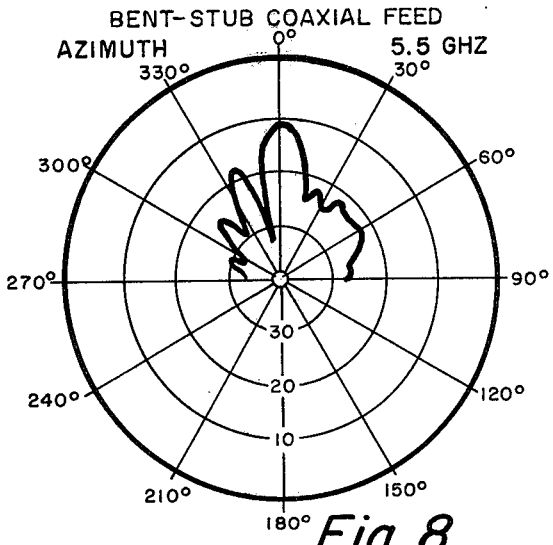
FIG. 8 shows a typical azimuth radiation pattern for the antenna horizontally-polarized coaxial feed in conjunction with a grounded bent-stub.
Figure 9:
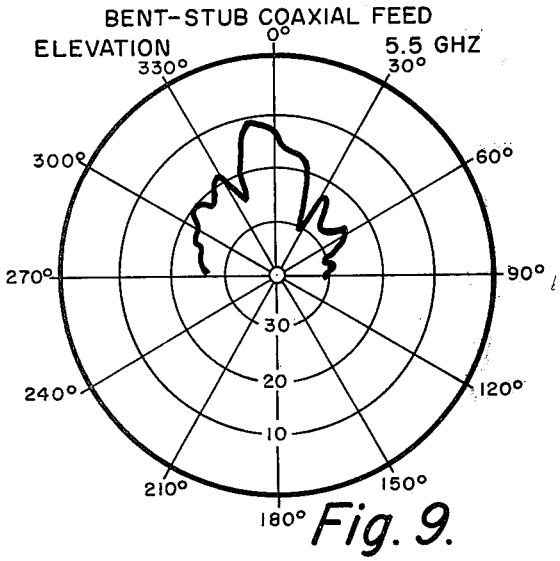
FIG. 9 shows a typical elevation radiation pattern for the antenna vertically-polarized coaxial feed (i.e., bottom feed) at the low-end antenna beamwidth.
Figure 10:
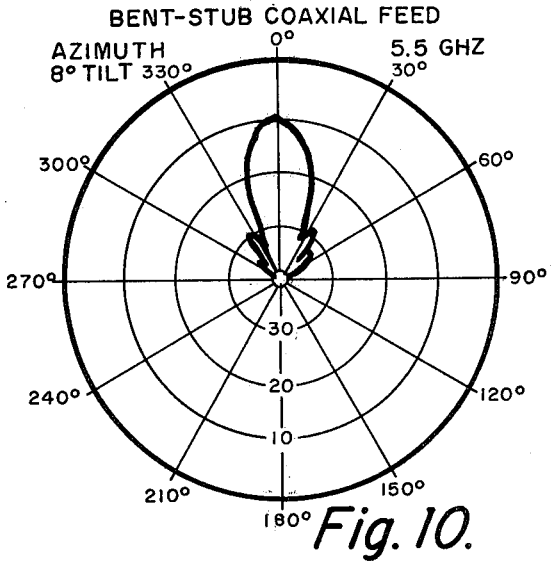
FIG. 10 shows a typical azimuth radiation pattern at 8 degrees tilt for the antenna vertically-polarized coaxial feed (i.e., bottom feed) at the low-end antenna beamwidth.
Figure 11:
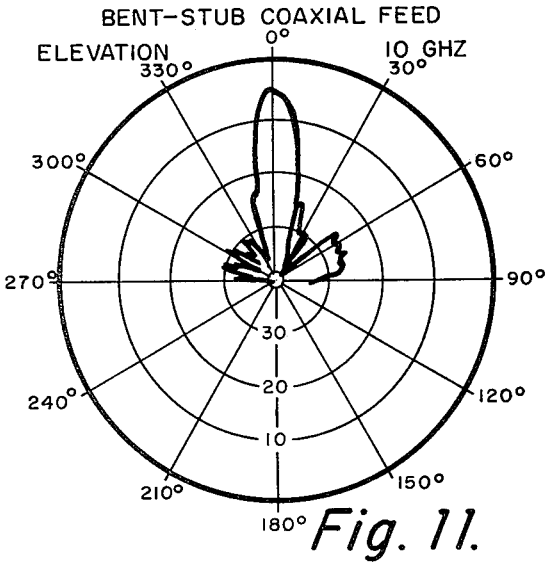
FIG. 11 shows a typical elevation radiation pattern for the antenna vertically-polarized coaxial feed (i.e., bottom feed) at the high-end of the frequency band.
Figure 12:
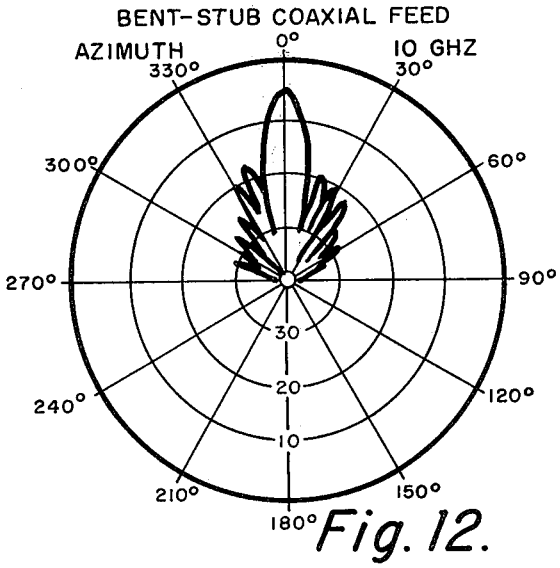
FIG. 12 shows a typical azimuth radiation pattern for the antenna vertically-polarized coaxial feed (i.e., bottom feed) at the high-end of the frequency band.

The horizontally-polarized coaxial feed 18 can be fabricated from a bulkhead connector 19 and a bent-stub 24, as shown in FIGS. 4*a*, 4*b* and 4*c*. This bent-stub coaxial feed 18 is used in conjunction with a grounded bent-stub 24 as shown in FIGS. 3*a*, 3*b* and 4*a*. The stubs 18 and 24 are bent to an angle of 90 degrees, and are bent at a point such that the bent ends will be parallel to and 0.20 midband wavelengths (λ) above ground plane 14, and the length of the bent end of each of the stubs 18 and 24 is 0.24λ. The coaxial stub 18 is mounted 0.45λ to the starboard side of the ground plane center and the grounded stub 24 is mounted 0.45λ to the port side of the ground plane center. Stubs 18 and 24 are oriented such that the bent ends 25 and 27, respectively, of the stubs are horizontal, as shown in FIGS. 3*a* and 3*b*, and point at the roll axis 21 of the antenna. This orientation and feed position directs horizontally-polarized antenna radiation through Luneberg lens 12 in a direction approximately parallel to the roll axis of the antenna. The radiation patterns for this feed are shown in FIGS. 7 and 8. The antenna gain is 13.5 dBi and the radiation is directed parallel to the roll axis of the antenna (see FIG. 7). The antenna beamwidth is approximately 15 degrees in elevation (see FIG. 7) and 18 degrees in azimuth (see FIG. 8).

The vertically-polarized coaxial feed 20 is identical to the horizontally-polarized coaxial feed 18, as are the typical dimensions given in FIG. 4*b*. As shown in FIG. 4*a*, coaxial feed 20 is mounted 0.2λ below the center of ground plane 14, such that the bent end 29 of the stub is vertical and perpendicular to the direction of the roll axis of the antenna. The radiation patterns for feed 20 are shown in FIGS. 9, 10, 11 and 12. At the low end of the frequency band, the antenna gain is 13.5 dBi and the radiation is directed 8 degrees below the roll axis of the antenna. The low-end antenna beamwidth is 21 degrees in elevation (see FIG. 9) and 20 degrees in azimuth (see FIG. 10). At the high end of the frequency band, the antenna gain is 20 dBi and the radiation is directed approximately parallel to the roll axis of the antenna. The high-end antenna beamwidth is 12 degrees in elevation (see FIG. 11) and 9 degrees in azimuth (see FIG. 12).

Figure 13:
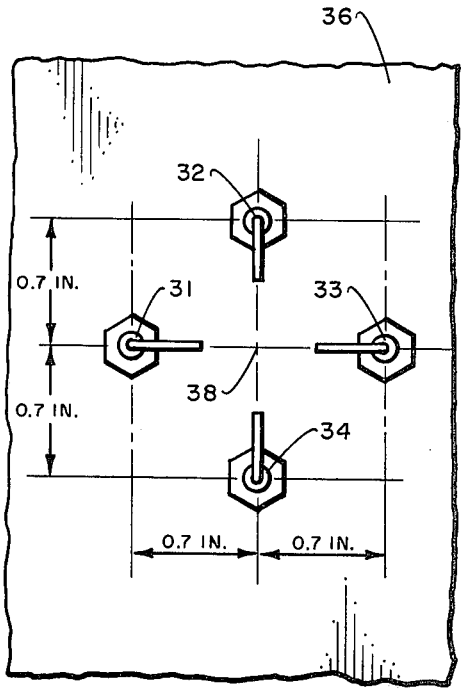
FIG. 13 is an enlarged detail view of the central portion of the ground plane showing another embodiment of the invention using four bent-stub coaxial feeds.

Another embodiment of the invention is shown in the antenna feed configuration of FIG. 13. This embodiment uses a common antenna aperture to provide antenna performance for four separate coaxial feeds. In the configuration, as shown, four bent-stub coaxial feeds 31, 32, 33 and 34 are used to drive a microwave lens as in the embodiment shown in FIGS. 1 and 2. The bent-stub coaxial feeds are mounted on a ground plane 36 such that they are symmetrically located about the roll axis 38 of the antenna (perpendicular to the plane of the drawing) and the center of the ground plane. Coaxial feeds 31, 32, 33 and 34 can be used independently, coupled in pairs, or coupled all together. Since opposing feeds are out of phase, they can be coupled in pairs with 180-degree couplers to maximize antenna gain for linear polarization. Also a 90-degree coupler can be used to configure adjacent antenna feeds for circular polarization.

The use of a common antenna aperture to provide antenna performance for three separate feeds, as shown in FIGS. 1 and 3, and the use of coaxial feeds, instead of merely waveguide feeds, with a Luneberg lens are believed to provide advantages not available from prior art systems. In addition, using the coaxial feed configuration of FIG. 13, the ability to radiate microwave energy from more than one Luneberg lens antenna feed with a unique frequency, polarization, and direction of radiation is possible; this ability was not feasible using waveguide feeds exclusively.

Figure 2:
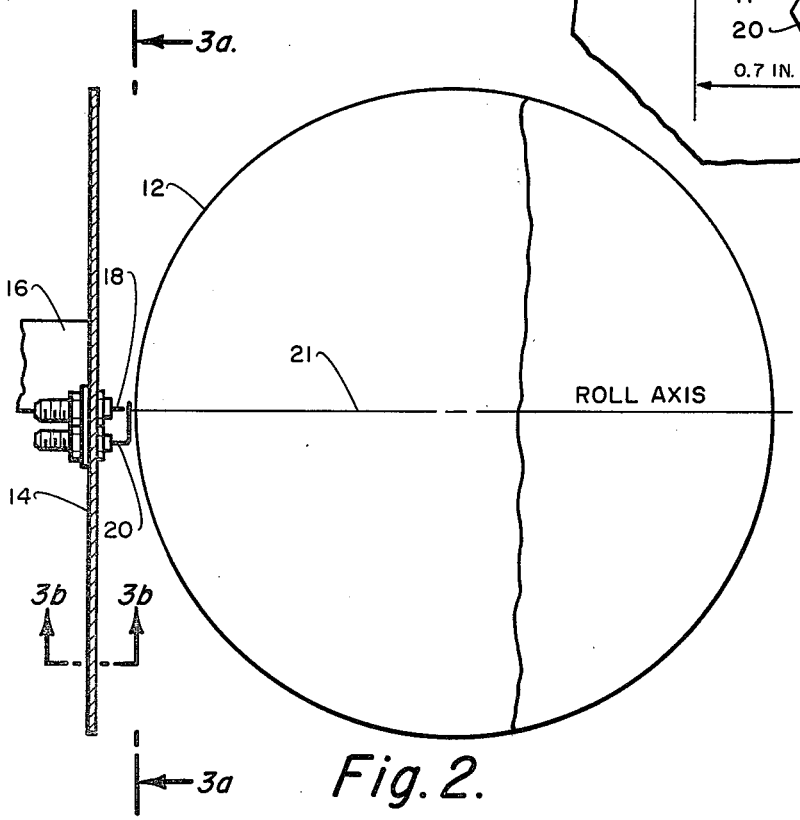
FIG. 2 is a side plan view of the antenna of FIG. 1.

The size of the microwave lens is generally determined by the desired direction of the radiation pattern together with the locations of the antenna feeds. While it is structurally more convenient or desirable to have the ground plane the same diameter as the microwave lens, as shown in FIGS. 1 and 2, the ground plane can be of any size, but should be at least approximately 2λ in diameter.

Obviously, many modifications and variations of the present invention are possible in the light of the above teachings. It is therefore to be understood that within the scope of the appended claims the invention may be practiced otherwise than as specifically described.

What is claimed is:

1. A multi-mode microwave lens antenna system using a common aperture for use in transmitting and receiving microwave radiation substantially in the direction of the antenna roll axis, comprising:

(a) a metallic ground plane having its center on the antenna roll axis with said roll axis being normal thereto;

(b) a microwave lens mounted with its primary axis along the antenna roll axis with its focal point close to said ground plane;

(c) a plurality of separate antenna feeds mounted about the center of said ground plane and said antenna roll axis;

(d) said plurality of separate antenna feeds including at least two bent-stub coaxial feeds;

(e) said bent-stub coaxial feeds having the ends thereof bent at an angle of 90 degrees with the bent ends being parallel to said ground plane at a selected distance in wavelength above said ground plane; the length of said bent ends being a desired dimension in wavelength;

(f) said bent-stub coaxial feeds being oriented such that the bent ends thereof point at the antenna roll axis;

(g) the orientation and position of said antenna feeds being operable to direct both horizontally-polarized and vertically-polarized antenna radiation through said microwave lens in the general direction of said antenna roll axis;

(h) said microwave lens being operable to focus microwave transmissions to and from said antenna feeds to provide antenna performance with high gain and narrow bandwidth.

2. An antenna system as in claim 1 wherein said microwave lens is a Luneberg lens.

3. An antenna system as in claim 1 wherein said ground plane is at least two wavelengths in diameter.

4. An antenna system as in claim 1 wherein said plurality of antenna feeds include, in addition to said two bent-stub feeds, an open-ended waveguide feed mounted normal to said ground plane.

5. An antenna system as in claim 4 wherein the lower edge of said open-ended waveguide feed is located adjacent to the center of said grounded plane.

6. An antenna system as in claim 5 wherein said open-ended waveguide feeds microwave energy through a rectangular orifice in said ground plane.

7. An antenna system as in claim 6 wherein the width of said rectangular orifice is equal to the width of said waveguide feed and the height of said rectangular orifice is less than the height of said open-ended waveguide feed whereby the ground plane forms an iris over a portion of said open-ended waveguide feed; said iris size being selected to electrically match the feed impedance for a given microwave frequency to reduce any standing wave ratio at a given microwave frequency.

8. An antenna system as in claim 1 wherein one of said at least two bent-stub coaxial feeds is horizontally-polarized and is used in conjunction with a grounded bent-stub which is mounted horizontal thereto on and across the center of said ground plane therefrom with each being equidistant from the center of said ground plane; the bent ends of said bent-stub coaxial feed and said ground bent-stub both being parallel to said ground plane at a selected distance above said ground plane and being oriented to point at each other and said antenna roll axis whereby horizontally-polarized antenna radiation is directed through said microwave lens in a direction approximately parallel to said antenna roll axis.

9. An antenna system as in claim 1 wherein one of said at least two bent-stub coaxial feeds is vertically-polarized and is mounted below the center of said ground plane such that the bent end thereof is vertical and normal to said antenna roll axis.

10. An antenna system as in claim 1 wherein said at least two bent-stub coaxial feeds are identical.

11. An antenna system as in claim 1 wherein said plurality of separate antenna feeds include four bent-stub coaxial feeds mounted on said ground plane symmetrically about said antenna roll axis and center of the ground plane.

12. An antenna system as in claim 11 wherein said four bent-stub coaxial feeds are operated independently of each other.

13. An antenna system as in claim 11 wherein opposite bent-stub coaxial feeds are coupled in pairs with 180 degree coupler to maximize antenna gain for linear polarization.

14. An antenna system as in claim 11 wherein adjacent bent-stub coaxial feeds are configured together with 90-degree couplers to provide circular polarization.

15. An antenna system as in claim 11 wherein said four bent-stub coaxial feeds are identical.

* * * * *